United States Patent [19]

Markowicz

[11] Patent Number: 4,842,278

[45] Date of Patent: Jun. 27, 1989

[54] HIERARCHICAL LOTTERY NETWORK WITH SELECTION FROM DIFFERENTIATED PLAYING POOLS

[76] Inventor: Victor Markowicz, 11 Daniel Dr., Englewood, N.J. 07631

[21] Appl. No.: 207,009

[22] Filed: Jun. 10, 1988

Related U.S. Application Data

[63] Continuation of Ser. No. 869,413, Jun. 2, 1986, abandoned.

[51] Int. Cl.[4] ..... A63B 71/04

[52] U.S. Cl. ..... 273/138 A; 364/412; 273/DIG. 28

[58] Field of Search ..... 273/138 A, 1 E, DIG. 28, 273/85 G, 85 CP; 364/410–412

[56] References Cited

U.S. PATENT DOCUMENTS

| | | | |
|---|---|---|---|
| 3,124,674 | 3/1964 | Edwards et al. | 235/61.1 |
| 3,327,292 | 6/1967 | Erikson et al. | 340/172.5 |
| 3,505,646 | 4/1970 | Affel, Jr. et al. | 340/172.5 |
| 3,874,584 | 4/1975 | Foley | 234/128 |
| 4,072,930 | 2/1978 | Lucero et al. | 340/152 T |
| 4,277,064 | 7/1981 | Newman | 273/138 A |
| 4,322,612 | 3/1982 | Lange | 273/138 A |
| 4,323,770 | 4/1982 | Dieulot et al. | 273/138 A |
| 4,339,798 | 7/1982 | Hedges et al. | 273/138 A |
| 4,373,726 | 2/1983 | Churchill et al. | 273/138 A |
| 4,398,708 | 8/1983 | Goldman et al. | 273/138 A |
| 4,494,197 | 1/1985 | Troy et al. | 364/412 |
| 4,652,998 | 3/1987 | Koza et al. | 364/412 |
| 4,689,742 | 8/1987 | Troy et al. | 273/138 A |

FOREIGN PATENT DOCUMENTS

80/00404 4/1980 PCT Int'l Appl. .

*Primary Examiner*—Maryann Lastova

*Attorney, Agent, or Firm*—Steele, Gould & Fried

[57] ABSTRACT

A network of individual lottery systems, for example a national network of state lotteries, each of the state lotteries operating independently using data entry and validation stations for accepting player data and having independent structure for selecting individual winners based upon coincidence of player-selected data and random data. The individual lotteries feed through to a network-level lottery having a data processor for accepting player entry data for plays in differentiated win pools at the network level. The network pools are differentiated, for example, into a red pool, white pool, and blue pool, each one being selectable by the player and each being separately accumulated and separately awarded, whereby differentiation of the pools due to probability produces competition and additional interest.

20 Claims, 2 Drawing Sheets

| | | | | | | |
|---|---|---|---|---|---|---|
| RED | 35 | 24 | 1 | 7 | 10 | 31 |
| WHITE | 2 | 4 | 6 | 36 | 38 | 50 |
| BLUE | 9 | 13 | 39 | 11 | 16 | 5 |

CHOOSE FROM 1 TO 56

14

FIG. 5 PARAMETERS PER 32,468,436 BOARDS @ $1

| MATCH | ODDS | CASH PRIZE | % OF POOL |
|---|---|---|---|
| 3 | 1/27.6 | $ 5 (FIXED) | 36 |
| 4 | 1/589 | 28 | 9.5 |
| 5 | 1/36,076 | 1,714 | 9.5 |
| RED 6 | 1/32,468,436 | 2,423,000 | 15 |
| WHITE 6 | " | " | 15 |
| BLUE 6 | " | " | 15 |

HIERARCHICAL LOTTERY NETWORK WITH SELECTION FROM DIFFERENTIATED PLAYING POOLS

This is a continuation of copending application Ser. No. 869,413, filed June 2, 1986, now abandoned.

BACKGROUND OF THE INVENTION

This invention relates to the field of random number matching lotteries, and in particular to a network wherein a plurality of lottery systems of the type accepting player data and selecting winners, are connected to provide network level play, and in which the network level play has differentiated pools.

PRIOR ART

Various lottery systems are known in which players wager by selecting data which is then matched to winning data to determine winners and amounts won. Stand-alone games such as slot machines are a form of user-selection of data to be matched against winning data, the user initiating random number selection to be matched against posted win patterns. Such a system is relatively self-contained, but may be connected to other machines, defining a pari-mutuel pool.

A typical state-run lottery has numerous widely dispersed terminals. Communication between the terminals and the central processor is needed for recording and verifying transactions. Each user selects data, and each transaction is verified and recorded. The winning numbers for the lottery are chosen daily, weekly, etc., usually at a publicized event. Frequently, such lottery systems for each play entry require the user to mark a card with several selections (e.g., three to six selections) from a group of possible numbers (e.g., ranging from one to forty), which numbers are not repeated. By means of communication between a data entry terminal and a central computer, the player entry data is recorded and validated well before the winning number is selected, whereby it is not possible to alter a play entry record to cover a winning number. Furthermore, all data being centralized, the number of winners and the prize amounts, as well as the entry location, can be readily determined.

Winning numbers are often selected by random extraction of numbered ping pong balls from a drum. Electronic random means, roulette wheels, etc. are also possible. In any case, the user-entry numbers are matched with the later-selected winning numbers, and users are awarded if the numbers happen to coincide. Should more than one player have chosen all or a predetermined part of the winning numbers, then the winning pool is shared by these players. If no one wins, the prize pool can accumulate (roll over), wholly or partly, thereby increasing interest in the lottery due to the increased potential prize.

Systems according to the foregoing description are well-known for state-sponsored lotteries. Such systems are marketed, for example, by GTECH, Inc., of Providence, R.I.

State-run lottery systems with a central processor communicating with distributed terminals are also similar in some respects to other small scale pari-mutuel wagering systems. Examples include race track betting systems and the like, each race or other event being a pari-mutuel pool. In each case, player transaction data is accepted, recorded and validated. Following the determination of a winner by one means or another, wins are confirmed and the players are paid an amount depending upon the number of winners and the size of the pool. Where a plurality of pari-mutuel pools are connected in this manner, the result is a large number of unrelated possible plays. No features of the particular plays tie them together into a network in which factors are common to all play options.

State-sponsored lotteries are now quite popular. A typical state system may have separate games in which 3, 4 or 6 player-selected numbers from 1 to 40 define an entry. The games may run daily or weekly. Variations in the particular numbers are possible and tend to distinguish one state's games from another's. Prizes in the games may range from fixed prizes of $500.00 in a 3 digit selection game to several million dollars accumulated after several cycles of pari-mutuel wagering in a 6 choice/forty number game.

Systems having one or more features in common with the foregoing description can be found, for example, in U.S. Pat. Nos. 3,505,646 - Affel, Jr., et al; 3,327,282 - Eriksson, et al; 3,124,674 - Edwards, et al; 4,494,197 - Troy; 4,277,064 - Newman; 3,874,584 - Foley; 4,072,930 - Lucero, et al; International application PCT/US80/00404, and in many other disclosures.

The present invention builds upon the concept of win selection by random numbers and pari-mutuel betting in a state-sponsored type of lottery. A national lottery having the win selection and pool accumulation features similar to a plurality of connected state lotteries is provided. The state lotteries' input hardware is used to collect data, and a very large pool of lottery players all over the nation (or other collection of participating jurisdictions) are able to play. Competition and interest are increased by differentiating player pools into a small number of competing pools having similar features. The pari-mutuel nature of the betting pool accumulation causes the separate pools to perform differently due to probability even though they operate under the same procedures. The variation makes for substantial competition and interest. It is presently preferred that these differentiated pools (e.g., a "red" pool, "white" pool and "blue" pool) operate separately on a pari-mutuel basis, awarding an indefinite number of players an indefinite amount, the specific amount being calculated from the number of players, number of winners, etc.

SUMMARY OF THE INVENTION

It is an object of the invention to provide a supervised network of interconnected state lottery systems in which a large number of lottery players can participate in a national lottery, and to provide differentiated national pools in which the players participate on a pari-mutuel basis.

It is also an object of the invention to provide competition between a plurality of differentiated pari-mutuel pools of a lottery network, each of the pools operating under the same rules, competition occurring due to variations in performance caused by probability.

It is another object of the invention to provide these benefits in a system that is simple and familiar to its players, using well-known state lottery game terminals and/or indicia in each jurisdiction, but differentiated from the state game.

It is another object of the invention to provide a very large player pool for large jackpots and also to allow frequent winners of large jackpots.

It is also an object of the invention to provide numerous smaller prizes.

These and other objects are accomplished by a network of individual lottery systems, for example a national network of state lotteries, each of the state lotteries operating independently and using data entry and validation stations for accepting player data and having independent means for selecting individual winners based upon coincidence of player-selected data and random data. The individual lotteries feed through to a network-level lottery having data processing means accepting player entry data for plays in differentiated win pools at the network level. The network pools are differentiated, for example, into a red pool, white pool, and blue pool, each one being selectable by the player and each being separately accumulated and separately awarded, whereby differentiation of the pools due to probability produces competition and additional interest.

BRIEF DESCRIPTION OF THE DRAWINGS

There are shown in the drawings the embodiments which are presently preferred. It should be understood that the invention is not limited to the precise arrangements and instrumentalities shown in the drawings, wherein:

FIG. 5 is a table showing expected statistical and win parameters of the differentiated 6/56 preferred network lottery system.

DETAILED DESCRIPTION OF THE PREFERRED EMBODIMENTS

Figure 1:
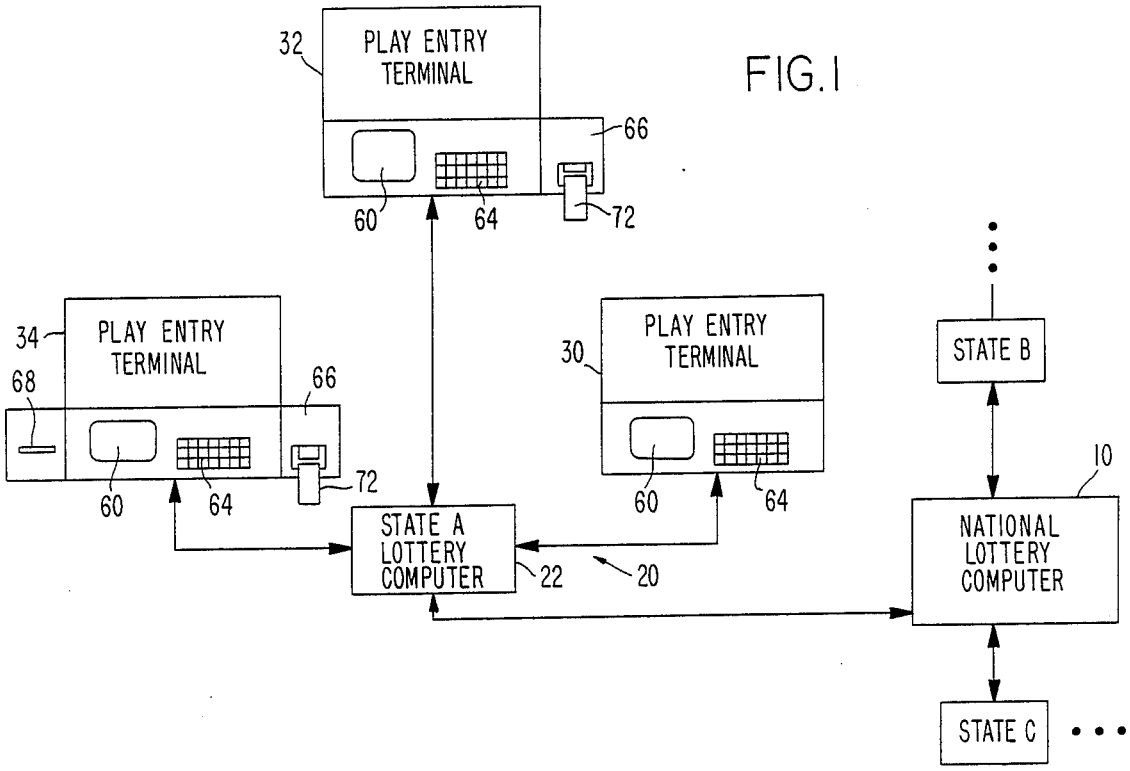
FIG. 1 is a schematic diagram of the national lottery system, showing elements of one state lottery system.

As shown in FIG. 1, the national lottery computer 10 connects a state lottery system 20 to other state lotteries via a grouped system for example a national system, forming a network of state systems by which data can be entered and validated to play the network (national) lottery game. The "network" as used herein can refer not only to national groupings. Regional or dispersed groupings are likewise possible.

In each individual lottery system such as "State A", the data entered on play entry terminals 30, 32, 34, for example by means of a mark-sensed entry card or by key pad 64 or the like, is transmitted to the state lottery computer 22 over phone lines, coded radio signals or over dedicated communication lines. A mark sense reader 68 can be provided in each play entry terminal, together with a data display screen 60, and a printer 66 producing a hard copy 72 to be given to the customer. However, the particulars of data entry and validation (e.g., the input/output mechanism and type of record) can vary between states having access to the national network. Therefore, the playing particulars will be familiar to players of each state lottery. the various buttons 52, 54, 56 on key pad 64 are used to select among different games at the state lottery level, and are also used according to the system of the invention to initiate a transaction with the national lottery computer 10. A plurality of state lottery computers 22 are connected to the national lottery computer 10 in a manner analogous to the connection of play entry terminals 30, 32, 34 to state lottery computer 22. Each state system accepts play data from users, just as the national network accepts play data from the state system computers. These processors communicate bidirectionally.

Play entries are initiated at the play entry terminals by keystrokes or marked cards and communicated to the national lottery computer 10 through state lottery computer 22. The entries are verified in communications conducted between the state lottery computer 22 and the play entry terminals. The state terminal then issues a printed record. A stored record of each transaction and the originating play entry terminal identity is also kept until a random number is chosen, against which the players' play entries are compared. Depending upon the coincidence of the play entries and a random number selected by any of various means, the winning entries are selected from all the players. The winners must claim their prizes, namely a monetary amount calculated on pari-mutuel terms to return a portion of the total amounts wagered. The remaining sums are the lottery proceeds that go to state purposes or to charities.

Figures 3, 4:
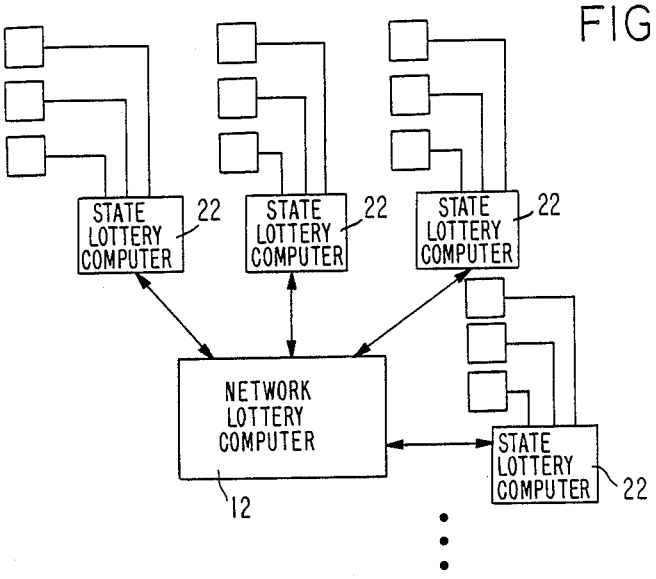
FIG. 3 is a schematic view of the national lottery system with a plurality of state lottery computers connected thereto.
FIG. 4 is a plan view of a player entry card showing pool differentiation and number selection.

FIG. 3 shows a system in which the network lottery computer (e.g., national lottery computer) communicates with the state computers 22, of which a plurality are provided. It is also possible to have regional network lottery computer 12, rather than a national one as shown in FIG. 1. Individual states may or may not have state lottery systems, and may or may not wish to subscribe to the national/regional lottery system. The system can likewise operate without regard to geographical proximity of the member jurisdictions.

Figure 2:
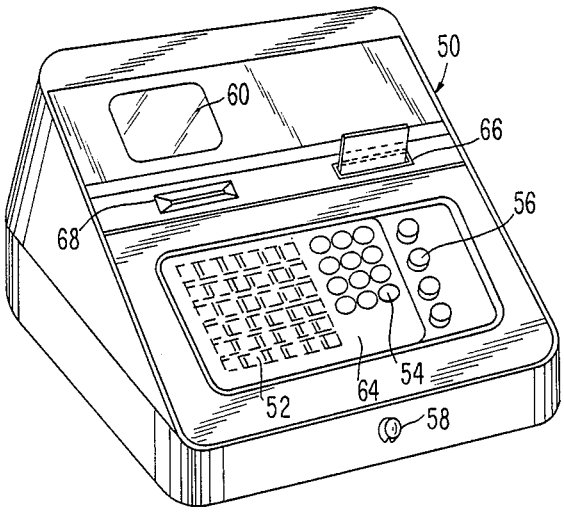
FIG. 2 is a perspective view of a player data entry terminal for accepting, ecording and validation player entry data.

Players may enter their selected numbers on a play entry card as shown in FIG. 4. In addition to the usual play entry cards used in the state lottery systems, an additional card 14, or an additional mark area on a mark sense card can be devoted to choosing entries for the national lottery. It may be desirable to have an entry on the national lottery printed either separately or directly on mark sense cards to be marked by the players and read by reader 68 of play entry terminals 50, as shown in FIG. 2. Identification marks can be provided to distinguish different games.

According to the invention, the national lottery game has attributes that distinguish it from statewide or other known pari-mutuel systems. No new data entry terminals are required, and the players are able to enter wagers on the national lottery system using their regular state lottery data entry terminals. Accordingly, game play is simple and the particulars for initiating play are familiar to the user. Nevertheless, the national game is differentiated from the state game, and provides a different and larger pari-mutuel pool. The regional or national nature of the pool makes the size of the jackpot that much larger. The large number of play number selections, and the selection of winners by coincidence of as few as three of the digits, also provide for many small prizes as well as regular very large winners, the latter occurring in the event all numbers are matched. All the member jurisdictions share the proceeds of the network lottery. The division preferably reflects player participation in each of the jurisdictions.

The winning numbers can be selected in the same manner as in a state lottery, for example by having numbered ping pong balls agitated in a number selection device, and selected in unpredictable manner during agitation. The selection will be a national/regional event, publicized and promoted. Prizes can be claimed through state lottery outlets.

Preferable game criteria provide for big winners as well as numerous winners. The user selects several numbers from a larger set of numbers, without repetition, in order to choose sets of numbers which will be compared against the random winning number. For example, the user selects six numbers ranging between 1 and 56, at an entry price of one dollar, for each of the separate pari-mutuel playing pools of the national lottery. The particular pools of the national network have the same rules and procedures, but are preferably differentiated for interest and competition. The network entries may be divided for example into the red, white and blue separate pools. By matching three or more numbers randomly chosen for the same color as selected, the prize is determined and, if claimed, is awarded. A minimum prize, for example matching three of the six random numbers will happen relatively frequently, e.g., one in every 27.6 plays. Therefore, assuming that a full complement of possible entries are found in the player entry boards, approximately 1.2 million players will win the minimum prize. It is also possible to win by matching 4, 5 or 6 numbers. The system may also vary by whether matching a chosen color with the number is required to win, the color (or other indicia) being indicated when a given play is entered. The table of FIG. 5 shows prefe red terms and odds, estimated cash prize and likely percent of the pari-mutuel pool to be devoted to each category. Although the winning match entries can be paid independent of whether the entries indicate the same color as selected, greater odds apply and greater cash prizes can be awarded to users that play big selecting the correct color as well as the correct number.

The red, white and blue jackpots may or may not be won on a given day, as is apparent from probability. If the jackpots are allowed to accumulate (roll over) from day to day until won, there arises a substantial difference in the jackpot for each of the colors. Over time the superstitious may find that the differentiated pools develop a reputation. At the least, the current possible jackpot will vary between the pools. If there are no winners for a given match in a given color, the jackpot preferably accumulates wholly or partly for that color until the next drawing. While the red, white and blue jackpots will often be nearly equal (i.e., when they have recently been won on the same day), they may vary substantially as they roll over independently.

It is preferred that unclaimed prizes also be accumulated, for example to create an annual or semi-annual super jackpot. For the super jackpot, a fourth set of numbers may be drawn.

It is possible to set prize amounts or to vary the prizes to be awarded for the more frequent 3 or 4 match wins on a pari-mutuel basis. The award may also be varied depending upon whether or not the user correctly matches the colors. For example, the match 4 and match 5 prizes can be computed individually for each color, or can have the same value for all the colors, depending on player selection.

According to the system, the expected maximum prize on a one dollar play is substantial at nearly 2.5 million dollars. However, in the same game, the odds of winning are better than 1 in 30 for a three number match. Furthermore, the variation between the prizes for the differentiated pools presents some competition and excitement.

Another possibility is to set a maximum prize per entry regardless of prior accumulations, for example at 20, 30 or 40 million dollars. When the jackpot remains at the maximum the whole excess can be devoted to a super-jackpot as described above, and will provide further variation and excitement between the pools. The maximum prize should be set high enough to attract the interest of many hopeful players.

The method and apparatus of the invention is easily applied to supplement state lottery systems, and benefits from a great deal of hardware and software already in place. Communications between the state lottery computer and the national computer 10 or other network computer 12, can be conducted similar to communications between other processors in the system and their respective peripheral devices.

By use of communications, protocols and verification schemes already known in the art, the national lottery becomes the centralized processor and the state lotteries become remote terminals. The invention requires a minimum of additional software and sufficient hardware for the central processor to communicate with existing state processors. In many cases such communications can be conducted over existing phone lines and modems, now in place for the state terminals to exchange date with their own data entry terminals.

The invention having been disclosed, a number of additional variations will occur to persons skilled in the art. Reference should be made to the appended claims rather than the foregoing specification as indicating the true scope of the invention.

What is claimed is:

1. A lottery game, comprising:

a plurality of entry and validation stations, each having means to accept player entry data and means to record the player entry data, the player entry data for each of the stations including selections of entries relating to a regional game and also entries in a further centralized game in which players entering a plurality of separate and distinct regional games also select plays for the further game at a more centralized level than said separate and distinct regional games, the further centralized game having at least one means for selecting a winner from players from all of the separate and distinct regional games;

a plurality of regional processing stations in data communication with the entry and validation stations, the regional processing stations receiving the player entry data for the further centralized game according to a predetermined game format, winning players being chosen according to predetermined game procedures in each of the regional games, from at least part of said player entry data;

a central processing station in data communication with at least one of the entry and validation stations and the regional processing stations, the central processing station receiving the player entry data according to a further predetermined game format, winning players to be chosen at the more centralized level according to a further predetermined game procedure in which the player entry data is compared to a winning data pattern; and, means differentiating at least one of the player entry data, the predetermined game format and the predetermined game procedure, such that player entry data for successive plays is differentiated into separate playing pools, including regional and more centralized separate playing pools, the separate playing pools all operating according to procedures for determining winning players, and the separate playing pools varying over time as different numbers of plays and wins occur in said differentiated pools.

2. The lottery game of claim 1, wherein the player entry data includes a plurality of indicia selected from a large number of possible indicia, a win being selected by matching player entry data to a randomly selected winning data pattern for each of said regional and centralized games, and the playing pools being differentiated into at least three different pools at the more centralized level selected by the players.

3. The lottery game of claim 2, wherein the playing pools are differentiated into three pools by color designations.

4. The lottery game of claim 3, wherein one criterion for determining the winning player is correlation between at least three player-selected numbers and randomly-selected numbers for each of the differentiated pools.

5. A lottery network comprising:

a plurality of individual lottery systems, each having a data depository and each being operable independently to accept player entry data and to award winning players based upon a win selection procedure, the individual lottery systems further developing a selection of player entry data applicable to a second level of lottery system operating concurrently and defining a network lottery system in which separate and distinct sets of said individual lottery systems process entries for players at a second level apart from said winning players and said win selection procedure;

a network data processor in data communication with each said data depository of the individual lottery systems, the network data processor accepting player entry data from the individual lottery systems applicable to said network lottery system; and, a network win selection means, operable to select at least one network winner from players of the individual lottery systems over and above the winning players and the win selection procedure of said individual lottery systems.

6. The lottery network of claim 5, wherein the network encompasses a geographic region and the individual lottery systems are local lotteries within the region.

7. The lottery network of claim 6, wherein the lottery network is a national lottery and the individual lottery systems are local jurisdiction lotteries operated concurrently.

8. The lottery network of claim 7, wherein the lottery network has a plurality of coextensive win pools differentiating between players, a random win number being chosen for each of said pools.

9. The lottery network of claim 8, wherein a single winning criteria is used invariably for all the win pools, but parameters affecting at least one of a winning amount, a maximum win amount, a number of winners and an amount of roll over vary over time between the differentiated win pools.

10. The lottery network of claim 9, wherein the single winning criteria is correlation between player selected data and a random winning data pattern chosen for each of the win pools, different numbers of players, winners and win amounts being experienced by each of said win pools, whereby competition arises between the pools.

11. A national lottery system, comprising:

a plurality of state lottery systems accepting player data at play terminals and selecting winning players for each of said state lottery systems, the state lottery systems being operable independently; and a national network system of data communication between the state lottery systems, the national network system selecting additional winning players from a pool of players at the play terminals of the state lottery systems, the play terminals for the state lottery systems each having means for generating indicia applicable to the national network system whereby said additional winning players are selected from players of the state lottery systems.

12. The national lottery system of claim 11, wherein the additional winning players are selected by coincidence of player selected data and randomly-selected data.

13. The national lottery system of claim 12, wherein winners are selected based upon coincidence of player selected data of at least four random numbers within a predetermined range.

14. The national lottery system of claim 13, wherein winners are selected based upon extent of coincidence of six player-selected numbers between 1 and 56.

15. The national lottery system of claim 14, wherein wins are selected in increasing amounts of winning for closer coincidence of player-selected data to the random numbers.

16. The national lottery system of claim 15, wherein at least three matching numbers are needed to win an award, and fewer matching numbers are awarded a fixed prize, and more matching numbers are awarded a pari-mutuelly variable prize.

17. The national lottery system of claim 12, wherein the additional winning players are chosen in a plurality of differentiated categories, winners for each of the categories being concurrently selected and the individual categories corresponding to separate win pools.

18. The national lottery system of claim 17, wherein the separate pools are differentiated by color of at least one of player entry indicia, play terminals and win selection indicia.

19. The national lottery system of claim 18, wherein the pools are differentiated as a red pool, a white pool and a blue pool, each player selecting six entry numbers of 56 possible numbers without repeats, players having at least three numbers matching a randomly-selected six numbers from the same possible numbers being considered winners.

20. The national lottery system of claim 17, wherein the differentiated pools have different numbers of players and winners, and award amounts are subject to a maximum, excess player entry proceeds being accumulated and the separate win pool for each of the differentiated pools being independently variable.

* * * * *